US005363831A

United States Patent [19]

Tomisawa et al.

[11] Patent Number: 5,363,831

[45] Date of Patent: Nov. 15, 1994

[54] METHOD OF AND AN APPARATUS FOR CARRYING OUT FEEDBACK CONTROL ON AN AIR-FUEL RATIO IN AN INTERNAL COMBUSTION ENGINE

[75] Inventors: Naoki Tomisawa; Satoru Watanabe; both of Atsugi, Japan

[73] Assignee: Unisia Jecs Corporation, Atsugi, Japan

[21] Appl. No.: 152,494

[22] Filed: Nov. 16, 1993

[51] Int. Cl.[5] ..... F02D 41/14

[52] U.S. Cl. ..... 123/695; 123/696

[58] Field of Search ..... 123/693, 694, 695, 696

[56] References Cited

U.S. PATENT DOCUMENTS

| | | | |
|---|---|---|---|
| 4,498,441 | 2/1985 | Ohgami et al. | 123/696 X |
| 4,671,244 | 6/1987 | Clement et al. | 123/696 X |
| 4,825,837 | 5/1989 | Nakagawa | 123/696 X |
| 4,825,838 | 5/1989 | Osuga et al. | 123/695 X |
| 5,121,732 | 6/1992 | Benninger et al. | 123/696 X |
| 5,207,056 | 5/1993 | Benninger | 123/696 X |
| 5,239,975 | 8/1993 | Mallebrein et al. | 123/696 |
| 5,243,952 | 9/1993 | Ikuta et al. | 123/695 X |
| 5,263,464 | 11/1993 | Yoshida et al. | 123/696 X |
| 5,311,853 | 5/1994 | Takahashi et al. | 123/695 X |

FOREIGN PATENT DOCUMENTS 60-240840 11/1985 Japan .

*Primary Examiner*—Willis R. Wolfe

*Attorney, Agent, or Firm*—Foley & Lardner

[57] ABSTRACT

An air-fuel ratio feedback correction value is used to correct the quantity of fuel supplied to an engine. The correction value is subjected to proportional-integral control to be carried out according to an air-fuel ratio detected by an oxygen sensor according to the oxygen concentration in exhaust. A response delay time occurring in the air-fuel ratio feedback control system is calculated, and according to the response delay time, the air-fuel ratio feedback correction value is adjusted. Even with the response delay time in the feedback control system, an actual air-fuel ratio is substantially converged to a target air-fuel ratio.

12 Claims, 5 Drawing Sheets

METHOD OF AND AN APPARATUS FOR CARRYING OUT FEEDBACK CONTROL ON AN AIR-FUEL RATIO IN AN INTERNAL COMBUSTION ENGINE

TECHNICAL FIELD

The present invention relates to a method of and an apparatus for carrying out feedback control to attain a target air-fuel ratio for an intake air-fuel mixture supplied to an internal combustion engine, and particularly, to a technique of compensating a response delay time in a feedback control system and improving the responsibility of the feedback control.

BACKGROUND ART

An example of a feedback control apparatus for controlling an ratio in an internal combustion engine is disclosed in Japanese Unexamined Patent Publication No. 60-240840.

This apparatus employs an oxygen sensor that detects the concentration of oxygen in exhaust. According to the oxygen concentration, the apparatus determines whether an actual air-fuel ratio is rich or lean relative to a theoretical air-fuel ratio. According to a result of the determination, the supply of fuel is feedback to controlled so that the actual air-fuel ratio becomes close to the theoretical air-fuel ratio.

When the actual air-fuel ratio greatly deviates from the theoretical one due to acceleration or declaration in the engine, the conventional feedback control system produces a large control factor to speedily attain the theoretical air-fuel ratio.

The feedback control system however, involves a response delay time. Namely, it takes time until a result of correction on the fuel supply according to the air-fuel ratio feedback control is detected by the oxygen sensor as a change in the oxygen concentration. This response delay time involves an intake air travel time, a gas residence time in a cylinder, delay of exhaust travel time, and a response delay time of the oxygen sensor itself. Accordingly, in the conventional feedback control system, the control factor is determined so that control time constants become approximately equal to these delay times, to converge the feedback control.

The response delay time in the conventional feedback control system hinders the control responsibility. If the deviation of an actual air-fuel ratio from a theoretical air-fuel ratio is large due to a transient operation, it takes a long time to attain the theoretical air-fuel ratio due to the response delay time in the feedback control system, and the quality of exhaust will deteriorate during this response delay time.

SUMMARY OF THE INVENTION

To solve these problems, an object of the present invention is to carry out feedback control on an air-fuel ratio in an internal combustion engine in consideration of a response delay time in a feedback control system, to improve the responsibility of the feedback control, while converging the feedback control.

Another object of the present invention is to accurately detect the response delay time as a value corresponding to an actual condition, to secure the accuracy of the feedback control allowing for the response delay time.

Still another object of the present invention is to reflect the feedback control coping with the response delay time on the formation of an air-fuel mixture to the engine.

In order to accomplish these objects, the present invention provides a method of and an apparatus for carrying out feedback control on an air-fuel ratio in an internal combustion engine. The method and apparatus detect the air-fuel ratio of an intake air-fuel mixture supplied to the engine by detecting the concentration of a specific gas component in exhaust which changes due to the the air-fuel ratio of the intake air-fuel mixture supplied to the engine. The method and apparatus control an air-fuel ratio feedback correction value, which is used to correct the quantity of fuel supplied by a fuel supply unit to the engine, so that the value becomes closer to a target air-fuel ratio.

The method and apparatus calculate the response delay time of the air-fuel ratio feedback control system, and at the same time, find a value indicating the deviation of an actual air-fuel ratio from the target air-fuel ratio according to the detected concentration of the specific gas component or the air-fuel ratio feedback correction value.

According to the response delay time and the value indicating the deviation of the actual air-fuel ratio from the target air-fuel ratio, the feedback correction value is correctively set, and according to the correctively set value, the quantity of fuel supplied by the fuel supply unit to the engine is correctively controlled.

The sum of correction requirements for the response delay time is predictable according to the response delay time and the deviation from the target air-fuel ratio, and on the basis of such correction requirements, the air-fuel ratio feedback correction value is correctively set to converge the feedback control and improve the responsibility of the air-fuel ratio feedback control.

The air-fuel ratio sensor may be a sensor whose output value changes in response to a change in the concentration of oxygen in exhaust, and wherein only a theoretical air-fuel ratio is detectable according to the output value.

With this sensor, the air-fuel ratio of an intake air-fuel mixture to the engine is detected as the concentration of oxygen in exhaust, and a theoretical air-fuel ratio is used as a target air-fuel ratio.

The air-fuel ratio feedback correction value may be subjected to proportional-integral control, on the basis of a judged value which is extracted from a judgement as to whether the air-fuel ratio of an air-fuel mixture to the engine is rich or lean relative to a target air-fuel ratio, so that the air-fuel ratio feedback correction value is controlled on the basis of the detection result of the air-fuel ratio of an intake air-fuel mixture.

If the actual air-fuel ratio is rich (lean) with respect to the target air-fuel ratio, the air-fuel ratio feedback correction value is controlled to reduce (increase) the supply of fuel so that the actual air-fuel ratio becomes dose to the target air-fuel ratio.

Preferably, the response delay time in the feedback control system is calculated at least from a residence time of a gas in a cylinder, a delay of an exhaust travel time, and a response delay time intrinsic to the air-fuel ratio sensor.

Namely, according to the air-fuel ratio feedback control system of the present invention, even if the quantity of fuel to be supplied to the engine is corrected according to the air-fuel ratio feedback correction value, a change in the air-fuel ratio due to the correction is detected only after an air-fuel mixture from the fuel supply unit is drawn into each cylinder of the engine, the mixture is combustion in the cylinder, the exhaust after combustion is discharged from the cylinder to the air-fuel sensor and further, the response delay time of the sensor elapses delays the detection. Accordingly, the present invention calculates the response delay time involved in detecting an air-fuel ratio from the residence time of gas in the cylinder, the delay of the exhaust travel time, and the response delay time of the air-fuel ratio sensor.

The gas residence time is calculable according to an engine speed. The delay of the exhaust time travel is calculable according to the quantity of taken air to the engine. The response delay time of the air-fuel ratio sensor is a fixed value. The sum of these values is used as the response delay time of the air-fuel ratio feedback control system.

Namely, the gas residence time in the cylinder is determined according to the intervals of suction and exhaust strokes that depend on an engine speed. The delay of the exhaust travel time is dependent on the flow rate of exhaust that is substantially equal to the quantity of intake air-. The response delay time of the air-fuel ratio sensor is the fixed value specific to the sensor.

If the deviation of an air-fuel ratio from a target air-fuel ratio and the response delay time of the air-fuel ratio feedback control system are used to correctively set the air-fuel ratio feedback correction value, a correction value for correcting the air-fuel ratio feedback correction value and a period for the correction are separately set according to the deviation and the response delay time, and then, the air-fuel ratio feedback correction value is correctively set by the correction value for said period.

With the structure mentioned above, even if the correction requirement is large, the correction is carried out for a predetermined period, to surely correct the correction value for the response delay time.

Other objects and features of the present invention will be described hereinafter in detail by way of preferred embodiments with reference to the accompanying drawings.

DESCRIPTION OF THE PREFERRED EMBODIMENTS

A method of and an apparatus for carrying out feedback control on an air-fuel ratio in an internal combustion engine according to an embodiment of the present invention will be explained with reference to FIGS. 2 to 6.

Figure 2:
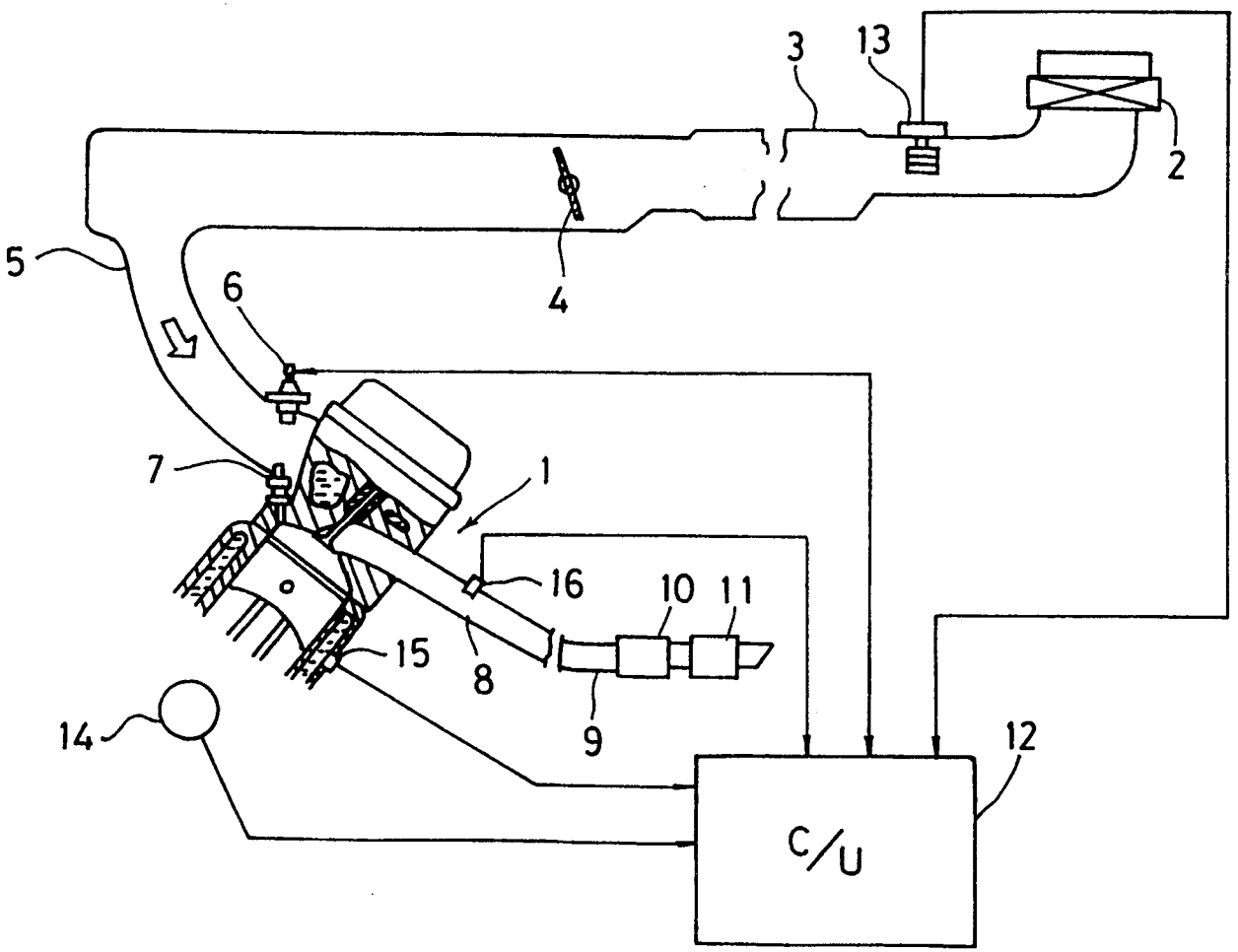
FIG. 2 is a schematic view showing an embodiment of the present invention.

In FIG. 2 showing an embodiment according to the present invention, intake air is guided into the internal combustion engine 1 through an air cleaner 2, an intake duct 3, a throttle valve 4, and an intake manifold 5. Each branch of the manifold 5 has a fuel injector 6 serving as a fuel supply means for supplying fuel to a corresponding cylinder.

The fuel injector 6 is of an electromagnetic type having a solenoid. The solenoid is energized to open the injector and de-energized to close the injector in response to an injection pulse signal provided by a control unit 12 to be described hereinafter. A fuel pump (not shown) feeds fuel, and a pressure regulator adjusts the pressure of the fuel to a predetermined level. The pressure adjusted fuel is intermittently injected into the engine 1 through the injector 6.

Each combustion chamber of the engine 1 has an ignition plug 7 to ignite an air-fuel mixture. Exhaust from the engine 1 is discharged outside through an exhaust manifold 8, an exhaust duct 9, a three-way catalyst 10, and a muffler 11.

The control unit 12 has a microcomputer having a CPU, a ROM, a RAM, an A/D converter, and an I/O interface. The control unit 12 receives various signals from sensors, processes the signals as described later, and controls the operation of the fuel injector 6.

One of the sensors is an airflow meter 13 arranged in the intake duct 3. The airflow meter 13 provides a signal representing an intake air quantity Q supplied to the engine 1.

Another of the sensors is a crank angel sensor 14, which generates a reference angle signal REF at each reference angle position and a unit angle signal POS at every one or two crank angle degrees. A period of the reference angle signal REF or the number of pulses of the unit angle signal POS for a predetermined period is determined to calculate an engine speed Ne.

Still another of the sensors is a water temperature sensor 15 for detecting the temperature Tw of cooling water in a water jacket of the engine 1.

Still another of the sensors is an oxygen sensor 16 serving as an air-fuel ratio sensor arranged at a collective part of the exhaust manifold 8.

The oxygen sensor 16 is a publicly known oxygen concentration cell that generates an electromotive force corresponding to the ratio of the oxygen concentration in exhaust to the oxygen concentration in atmosphere. With this sensor which utilizes that the oxygen concentration in exhaust steeply changes around the theoretical air-fuel ratio, only a theoretical air-fuel ratio is detectable based on the sudden change of the output of the oxygen sensor 16.

The CPU of the microcomputer incorporated in the control unit i 2 calculates basic fuel injection quantity Tp corresponding to a target air-fuel ratio, i.e., a theoretical air-fuel ratio according to the intake air quantity Q and engine speed Ne. At the same time, the control unit 12 sets various correction coefficients COEF including an incremental coefficient based on the cooling water temperature Tw and a correction coefficient for a transient operation. In addition, the control unit 12 calculates an air-fuel ratio feedback correction coefficient (value) $\alpha$ for controlling an actual air-fuel ratio to the target (theoretical) air-fuel ratio according to the output of the oxygen sensor 16.

The basic fuel quantity Tp is multiplied by the coefficients COEF and the air-fuel ratio feedback correction coefficient $\alpha$, to provide an effective fuel injection quantity Te ($\leftarrow Tp \times COEF \times \alpha$). A correction portion Ts is added to the effective fuel injection quantity Te. The correction portion Ts is to correct a change in the effective valve open time of the fuel injector 6 due to a change in a battery voltage. A result of the addition is set as a final fuel injection quantity (an injection pulse width) Ti ($\leftarrow Te+Ts$).

The control unit 12 provides, at a predetermined timing, the fuel injector 6 with an injection pulse signal whose pulse width corresponds to the final fuel injection quantity Ti, to thereby electronically control the quantity of fuel supplied to the engine.

The calculation of the feedback correction coefficient $\alpha$ by the control unit 12 will be explained in detail with reference to the flowchart of FIG. 3.

Figure 1:
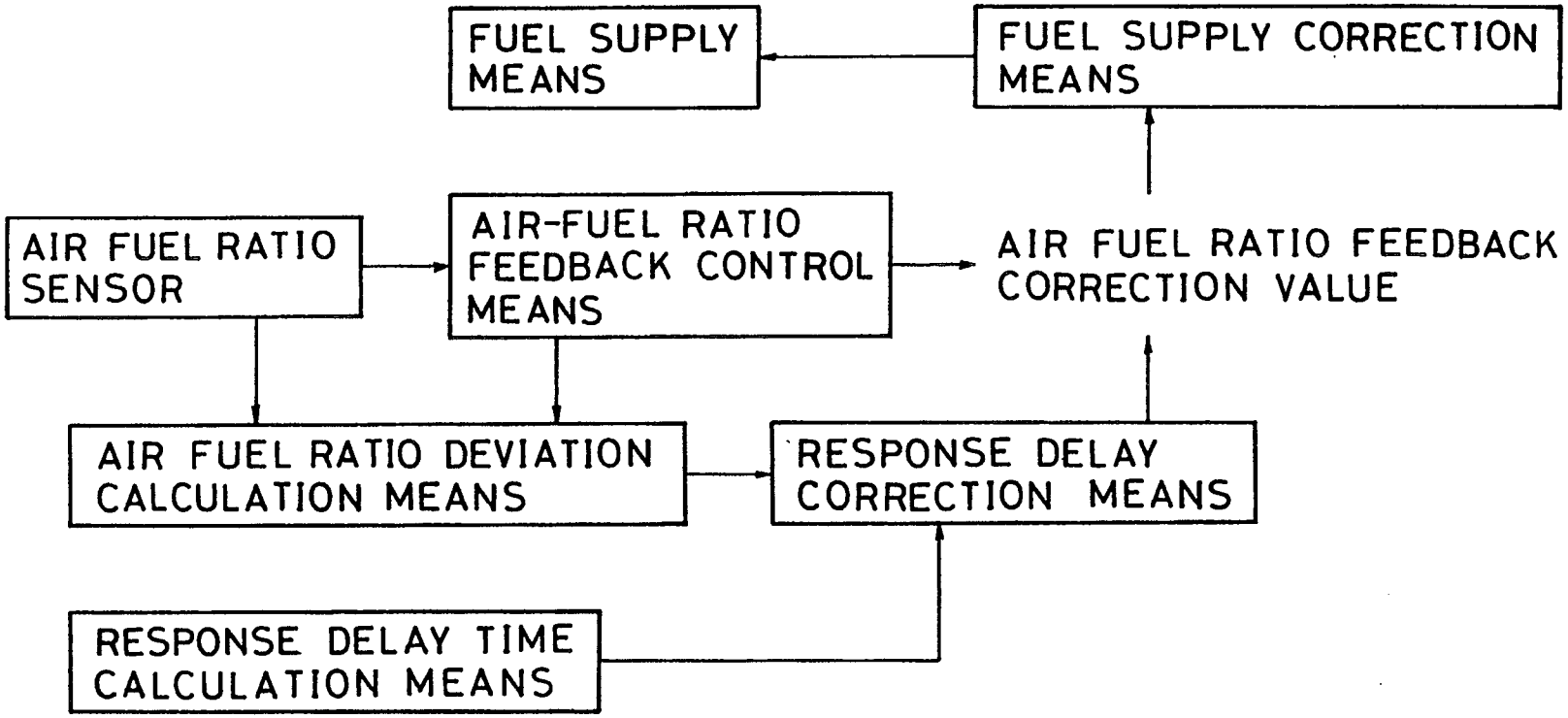
FIG. 1 is a block diagram showing an arrangement disclosed in claim 1 according to the present invention.

Further, among structural elements stated in claim 1 of the present invention and shown in FIG. 1, air-fuel ratio feedback control means, response delay time calculation means, air-fuel ratio deviation calculation means, response delay correction means, and fuel supply quantity correction means are software functions stored in the control unit 12. In the present embodiment, an air-fuel ratio sensor of FIG. 1 corresponds to the oxygen sensor 16, and fuel supply means corresponds to the fuel injector 6.

Figure 3A:
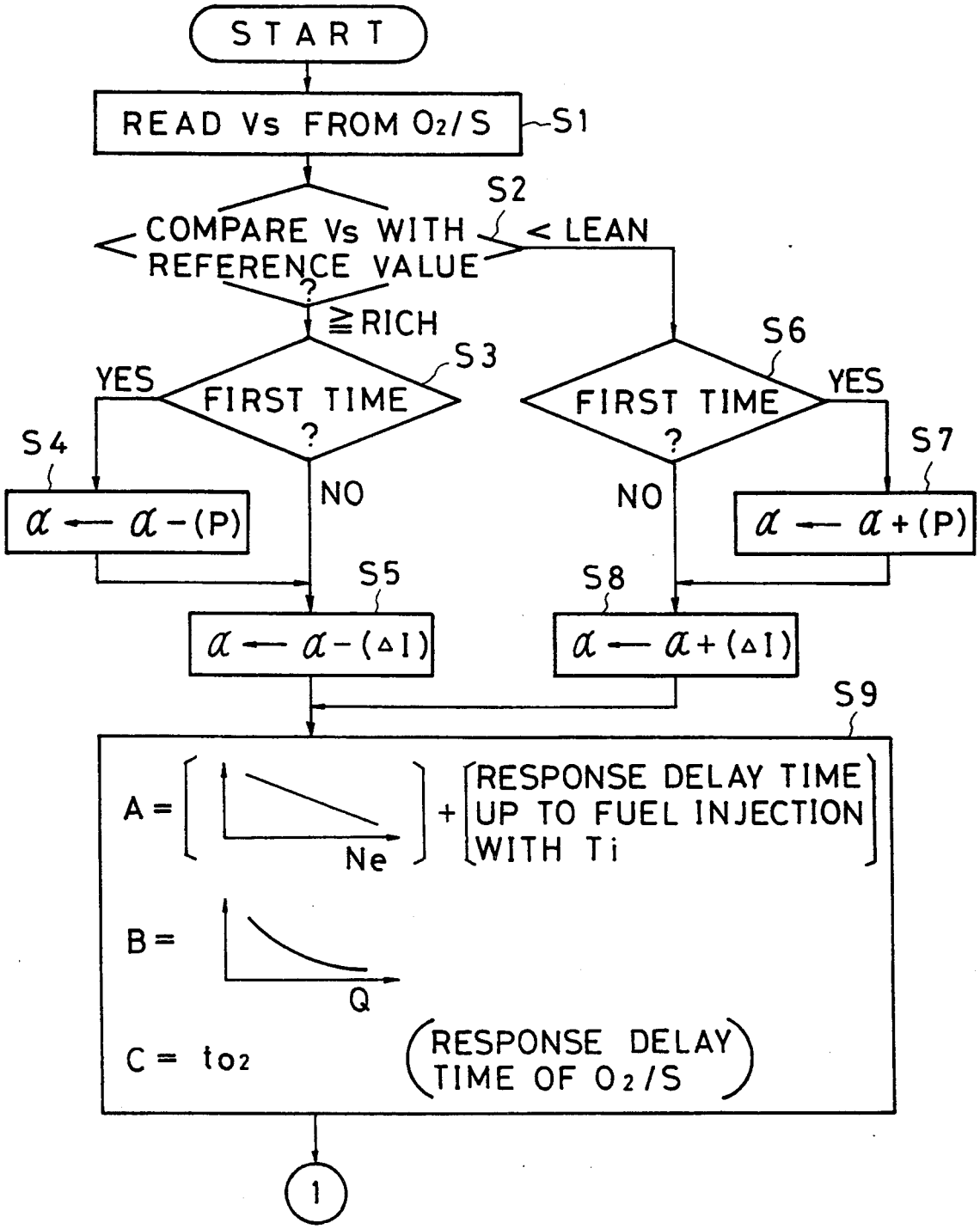
FIGS. 3A and 3B are flowcharts of steps of setting an air-fuel ratio feedback correction coefficient according to the embodiment.
Figure 3B:
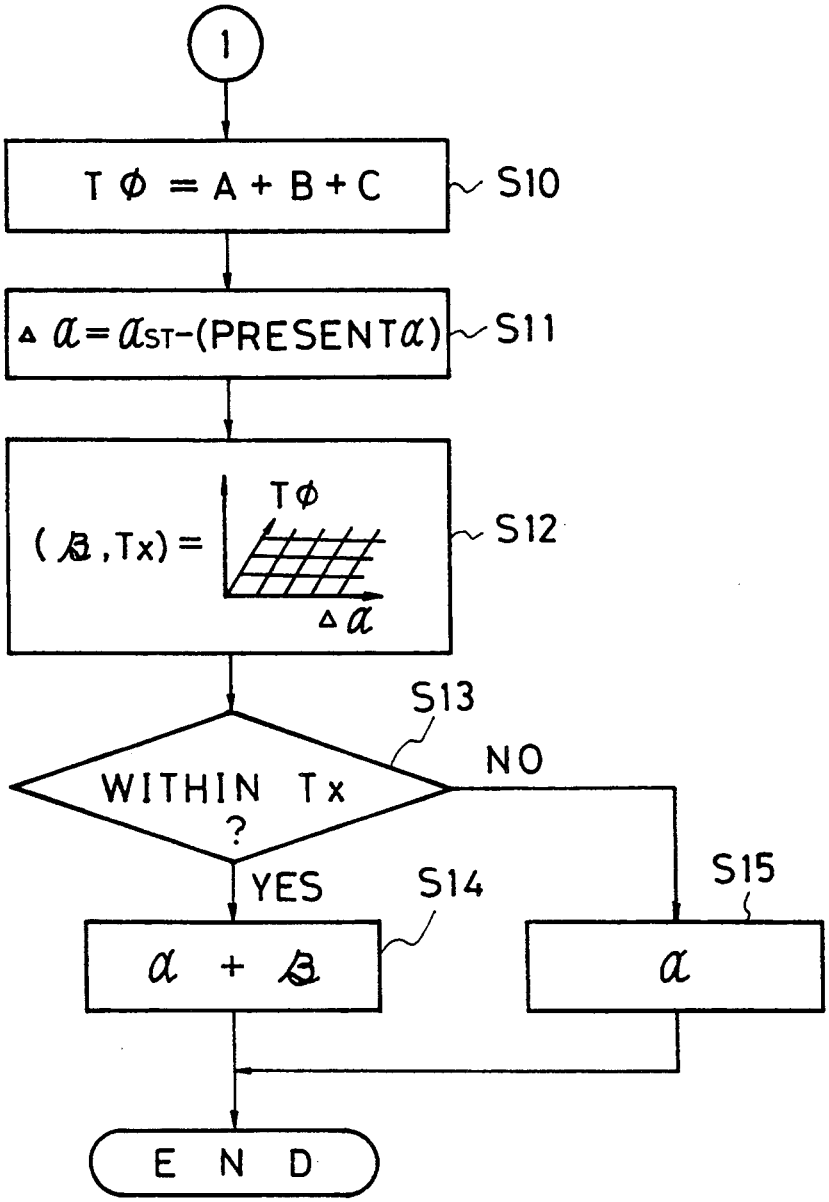

In the flowchart of FIG. 3, step S1 reads an output voltage Vs of the oxygen sensor 16.

Step S2 compares the output voltage Vs with a reference voltage corresponding to a theoretical air-fuel ratio and determines whether an actual air-fuel ratio is rich or lean relative to the theoretical air-fuel ratio, i.e., a target air-fuel ratio.

If the output voltage Vs is higher than the reference voltage and the step S2 determines that the actual air-fuel ratio is rich relative to the theoretical air-fuel ratio, step S3 determines whether or not it is the first rich decision after the air-fuel ratio has changed from the lean state to the rich state.

If it is the first rich decision, step S4 subtracts a predetermined proportional portion P from a present air-fuel ratio feedback correction coefficient $\alpha$. If it is not the first rich decision, step S5 subtracts a predetermined integral portion $\Delta I$ from the present air-fuel ratio feedback correction coefficient $\alpha$.

The decremental change of the air-fuel ratio feedback correction coefficient $\alpha$ results in decrementally correcting the final fuel injection quantity Ti. The integral control in the step S5 is continued by this decremental correction to cancel the rich state relative to the theoretical air-fuel ratio and gradually lean the air-fuel ratio.

The proportional portion P and integral portion $\Delta I$ may be set according to information such as engine load.

If the output voltage Vs is lower than the reference voltage and the step S2 determines that the actual air-fuel ratio is lean relative to the theoretical air-fuel ratio, step S6 determines whether or not it is the first lean decision. If it is the first lean decision, step S7 adds the proportional portion P to the air-fuel ratio feedback correction coefficient $\alpha$. If it is not the first lean decision, step S8 adds the integral portion $\Delta I$ to the air-fuel ratio feedback correction coefficient $\alpha$.

Figure 4:
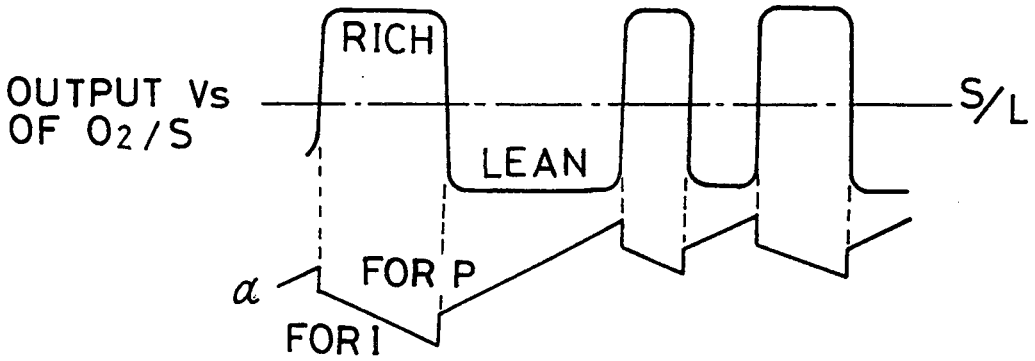
FIG. 4 is a time chart showing proportional-integral control carried out on the air-fuel ratio feedback correction coefficient according to the embodiment.

In this way, the steps S1 to S8 carry out the proportional-integral control on the air-fuel ratio feedback correction coefficient $\alpha$ to control the quantity of fuel injected by the fuel injector 6, so that the actual air-fuel ratio becomes close to the target air-fuel ratio as shown in FIG. 4.

After the air-fuel ratio feedback correction coefficient $\alpha$ is set by the proportional-integral control, step S9 calculates a response delay time, i.e., a period in which a result of the control made on the air-fuel ratio feedback correction coefficient $\alpha$ is detected by the oxygen sensor 16 as a change in the air-fuel ratio.

Namely, the response delay time as explained later presents until the control with the air-fuel ratio feedback control coefficient $\alpha$ is detected as a change in the air-fuel ratio.

The response delay time includes a delay time up to fuel is injected according to the correction coefficient $\alpha$, a delay time before the injected air-fuel mixture is drawn into a cylinder, a residence time of the gas in the cylinder, an exhaust travel time until exhaust discharged from the cylinder reaches the oxygen sensor 16, and a response delay time of the oxygen sensor until the output of the oxygen sensor 16 is changed in response to a change in the oxygen concentration in the exhaust. Only after the elapse of the sum of these delay times, a result of the air-fuel ratio feedback control is detectable as a change in the oxygen concentration in the exhaust. These delay times form the response delay time of the air-fuel ratio feedback control system in the present embodiment.

Due to said response delay time, control constants such as the proportional portion P and integral portion $\Delta I$ of the proportional-integral control are set to be time constants approximately equal to the response delay time.

The response delay time until the fuel injection is calculable according to a difference between a present crank angle and a crank angle at injection timing. The gas residence time in each cylinder is changed depending on an engine speed Ne. Accordingly, a map storing residence times corresponding to engine speeds is prepared, and the map is looked up to find a proper residence time. The sum of the injection delay time and residence time forms a response delay time A.

According to this embodiment, the response delay time A does not include the travel time of an intake air-fuel mixture to the engine that forms a response delay time in the intake system. This is because during a transient operation in which deterioration of response characteristic due to this intake delay time causes a problem, the fuel injection quantity Ti is adjusted for the intake delay time by a transient operation correction coefficient that is included in the various correction coefficients COEF. The response delay time A may include the intake delay time, which is dependent on the intake air quantity Q.

The delay of exhaust travel time depends on the quantity of the exhaust. A map storing exhaust transportation delay times according to the intake air quantity Q which is used instead of the quantity of exhaust is prepared to find a present exhaust travel delay time B.

The delay time of a change in the output of the oxygen sensor 16 in responding to a change in the oxygen concentration in atmosphere is stored as a fixed value $t_{02}$ in advance. This fixed value is set to a delay time C.

Step 10 adds the delay times A, B, and C to one another to calculate a response delay time $T\phi$ of the air-fuel ratio feedback control system.

Step 11 finds a deviation $\Delta\alpha$ of the feedback correction coefficient $\alpha$ from a feedback correction coefficient $\alpha_{ST}$ corresponding to the target air-fuel ratio. The deviation $\Delta\alpha$ is handled as a value corresponding to the deviation of the actual air-fuel ratio from the target air-fuel ratio.

The correction coefficient $\alpha_{ST}$ is the latest value of an average ((a+b)/2) of the maximum correction coefficient "a" and minimum correction coefficient "b" that are obtained whenever the air-fuel ratio changes from rich to lean or from lean to rich.

When the engine is in a stable state, the feedback correction coefficient $\alpha$ is controlled around a given level. If the engine enters a transient state from the stable state, an actual air-fuel ratio greatly deviates from a target air-fuel ratio. To compensate the deviation, the correction coefficient $\alpha$ is largely increased or decreased through the proportional-integral control. Namely, the correction coefficient $\alpha$ largely deviates from the average value in the transient state. This is why the deviation $\Delta\alpha$ is handled as a value corresponding to the deviation of the actual air-fuel ratio from the target air-fuel ratio.

Instead of the oxygen sensor 16 that detects only a theoretical air-fuel ratio, a known wide-range air-fuel ratio sensor may be employable to measure air-fuel ratios in a wide range from rich to lean. In this case, the deviation $\Delta\alpha$ corresponds to the deviation of the present sensor output from an output level corresponding to the target air-fuel ratio. In this way, the present invention is not limited to the oxygen sensor 16.

The wide-range air-fuel ratio sensor is capable of quantitatively detecting the deviation of an air-fuel ratio. Namely, the wide-range air-fuel sensor quickens the response delay correction compared with the oxygen sensor 16.

When the wide-range air-fuel sensor is employed, the proportional-integral control in the steps S1 to S8 sets the proportional portion according to the deviation of an actual air-fuel ratio from a target air-fuel ratio, and the integral portion is set according to an integral value of the deviation.

Step S12 calculates a correction value $\beta$ and a period Tx according to the response delay time $T\phi$ and air-fuel ratio deviation $\Delta\alpha$. The correction value $\beta$ is used to correct the feedback correction coefficient $\alpha$ for the response delay time $T\phi$. The correction by the value $\beta$ is carried out within the period Tx.

Figure 5:
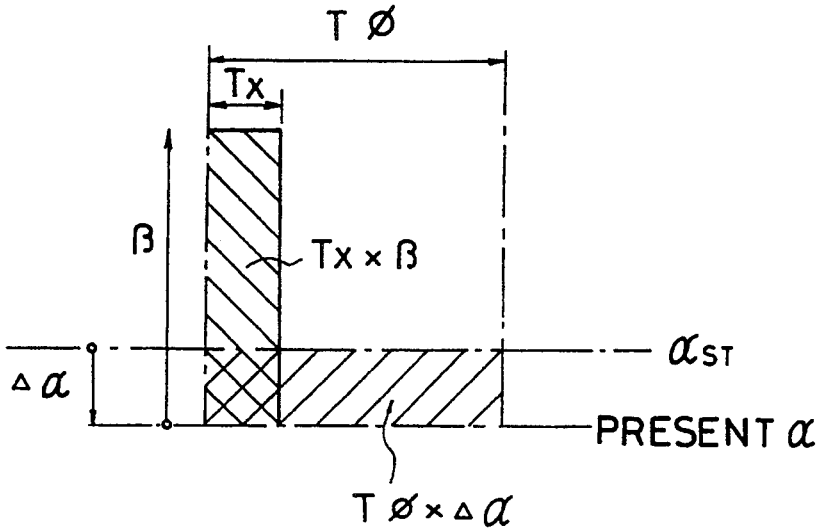
FIG. 5 is a diagram explaining the setting of a correction value $\beta$ for correcting the feedback correction coefficient according to the embodiment.

As shown in FIG. 5, the product of the response delay time $T\phi$ and the air-fuel ratio deviation $\Delta\alpha$ corresponds to the quantity of the correction for the response delay time $T\phi$. If this correction is carried out in a short period, the response delay time may be apparently eliminated.

Such a sudden adjustment, however, will cause an overshoot. The correction ($T\phi\times\Delta\alpha$) is convened into the correction period Tx and correction value $\beta$ so that the correction ($T\phi\times\Delta\alpha$) is carried out within the period Tx wherein the prevention of the overshoot is balanced with the improvement of the response characteristic.

Step S13 determines whether or not the correction period Tx lastly set in the step S12 has been elapsed. If it is within the correction period Tx, step S14 adds the correction value $\beta$ set simultaneously with the correction period Tx to the correction coefficient $\alpha$ that has been subjected to the proportional-integral control, to correctively set the correction coefficient $\alpha$. The correctively set coefficient $\alpha$ is used to correct the basic fuel injection quantity Tp and calculate the fuel injection quantity Ti ($\leftarrow Tp\times COEF\times(\alpha+\beta)+Ts$).

When the last correction period Tx elapses, step S15 stops to add the correction value $\beta$ and corrects the basic fuel injection quantity Tp only with the proportional-integral controlled coefficient $\alpha$, to calculate the fuel injection quantity Ti ($\leftarrow Tp\times COEF\times\alpha+Ts$). Namely, if an actual air-fuel ratio is stable around a target air-fuel ratio, the fuel injection quantity is corrected according to only the proportional-integral controlled correction coefficient $\alpha$.

Figure 6:
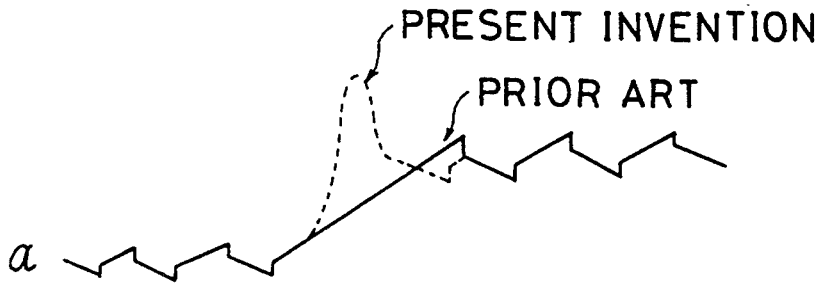
FIG. 6 is a time chart showing the correction of the response delay time according to the embodiment.

In this way, the correction value $\beta$ for compensating the response delay time is added to the correction coefficient $\alpha$, to improve the response characteristic of the air-fuel ratio feedback control system. As shown in FIG. 6, when an actual air-fuel ratio deviates from a theoretical air-fuel ratio during a transient operation, the correction coefficient $\alpha$ may be promptly adjusted to a value corresponding to the target air-fuel ratio (theoretical-air-fuel ratio), to thereby improve the quality of exhaust during the transient operation.

Although this embodiment employs the oxygen sensor 16 that detects only a theoretical air-fuel ratio, it is possible to employ the wide-range air-fuel ratio sensor as explained above. The wide-range air-fuel ratio sensor may be more expensive than the oxygen sensor 16, but it is capable of directly measuring the deviation of an actual air-fuel ratio from a target air-fuel ratio. Accordingly, it improves the response characteristic of the feedback control of the air-fuel ratio.

Although this embodiment employs the proportional-integral control to control the air-fuel ratio feedback correction coefficient $\alpha$, this does not limit the present invention.

This embodiment converts the air-fuel ratio deviation $\Delta\alpha$ and response delay time $T\phi$ into the correction value $\beta$ and correction period Tx, to correctively control an air-fuel ratio. It is possible to omit the setting of the correction period Tx. In this case, the correction value $\beta$ is set below a correction upper limit and is applied every time to compensate the response delay time.

This embodiment employs a theoretical air-fuel ratio as a target air-fuel ratio. It is possible to employ the wide-range air-fuel ratio sensor to use another air-fuel ratio as the target air-fuel ratio.

We claim:

1. An apparatus for carrying out feedback control on an air-fuel ratio in an internal combustion engine, comprising:

an air-fuel ratio sensor providing an output that changes in response to the concentration of a specific gas component in exhaust, the concentration of the specific gas component changing in response to the air-fuel ratio of an air-fuel mixture supplied to the engine;

air-fuel ratio feedback control means for controlling an air-fuel ratio feedback correction value for correcting the quantity of fuel supplied by fuel supply means to the engine to bring the air-fuel ratio detected according to the output value of the air-fuel ratio sensor close to a target air-fuel ratio;

response delay time calculation means for calculating a response delay time involved in the feedback control system carried out by the air-fuel ratio feedback control means;

air-fuel ratio deviation calculation means for calculating a value representing a deviation of the air-fuel ratio of the intake air-fuel mixture to the engine from the target air-fuel ratio according to at least one of the output value of the air-fuel ratio sensor and the air-fuel ratio feedback correction value;

response delay correction means for correctively setting the air-fuel ratio feedback correction value controlled by the air-fuel ratio feedback control means according to the value indicating the air-fuel ratio deviation calculated by the air-fuel ratio deviation calculation means and the response delay time calculated by the response delay time calculation means; and fuel supply quantity correction means for correcting and controlling the quantity of fuel supplied by the fuel supply means to the engine according to the air-fuel ratio feedback correction value.

2. The apparatus according to claim 1, wherein the air-fuel ratio sensor provides an output that changes in response to the oxygen concentration in the exhaust, and the output is useful to detect only a theoretical air-fuel ratio.

3. The apparatus according to claim 1, wherein the air-fuel ratio feedback control means determines whether the air-fuel ratio detected according to the air-fuel ratio sensor is rich or lean relative to the theoretical air-fuel ratio, and according to the determination, carries out proportional-integral control on the air-fuel ratio feedback correction value.

4. The apparatus according to claim 1, wherein the response delay time calculation means calculates the response delay time of the air-fuel ratio feedback control system including at least a residence time of a gas in a cylinder, a delay of exhaust travel time, and a response delay time of the air-fuel ratio sensor proper.

5. The apparatus according to claim 1, wherein the response delay time calculation means calculates the gas residence time according to an engine speed, the delay of exhaust travel time according to the quantity of intake air to the engine, and adds the results of these calculations to a stored fixed value representing the response delay time of the air-fuel ratio sensor, to provide the response delay time of the air-fuel ratio feedback control system.

6. The apparatus according to claim 1, wherein the response delay correction means determines a correction value for correcting the air-fuel ratio feedback correction value and a period for achieving the correction with the correction value, according to the value indicating the deviation of the air-fuel ratio calculated by the air-fuel ratio deviation calculating means and the response delay time of the feedback control system calculated by the response delay time calculation means, so that the air-fuel ratio feedback correction value is correctively set with the correction value within the period.

7. A method of carrying out feedback control on an air-fuel ratio in an internal combustion engine, comprising the steps of:

reading an output of an air-fuel ratio sensor, the output changing in response to the concentration of a specific gas component in exhaust, the concentration of the specific gas component changing in response to the air-fuel ratio of an air-fuel mixture supplied to the engine;

controlling an air-fuel ratio feedback correction value for correcting the quantity of fuel supplied by fuel supply means to the engine such that the air-fuel ratio detected according to the output value of the air-fuel ratio sensor is brought close to a target air-fuel ratio;

calculating a response delay time in the step of controlling the air-fuel ratio feedback correction value;

calculating a value indicating a deviation of the air-fuel ratio of the air-fuel mixture to the engine from the target air-fuel ratio, according to at least one of the output value of the air-fuel ratio sensor and the air-fuel ratio feedback correction value;

correctively setting the air-fuel ratio feedback correction value according to the value indicating the air-fuel ratio deviation and the response delay time; and correcting and controlling the quantity of fuel supplied by the fuel supply means to the engine according to the air-fuel ratio feedback correction value.

8. The method according to claim 7, wherein the output of the air-fuel ratio sensor changes in response to the oxygen concentration in the exhaust and is useful to detect only a theoretical air-fuel ratio.

9. The method according to claim 7, wherein the step of controlling the air-fuel ratio feedback correction value includes the steps of:

determining whether the air-fuel ratio of the air-fuel mixture to the engine is rich or lean with respect to the target air-fuel ratio according to the read output value of the air-fuel ratio sensor; and carrying out proportional-integral control on the air-fuel ratio feedback correction value according to the determination.

10. The method according to claim 7, wherein the step of calculating the response delay time calculates the response delay time including at least a residence time of a gas in a cylinder, a delay of exhaust travel time, and a response delay time of the air-fuel ratio sensor proper.

11. The method according to claim 7, wherein the step of calculating the response delay time includes the steps of;

calculating the gas residence time in the cylinder according to an engine speed;

calculating the delay of exhaust travel time according to the quantity of intake air- to the engine;

providing the response delay time of the air-fuel ratio sensor as a fixed value; and providing the sum of the gas residence time, the delay of exhaust travel time, and the response delay time of the air-fuel ratio sensor, as the response delay time in the step of controlling the air-fuel ratio feedback correction value.

12. The method according to claim 7, wherein the step of correctively setting the air-fuel ratio feedback correction value includes the steps of:

setting a correction value for correcting the air-fuel ratio feedback correction value and a period for carrying out the correction with the correction value, according to the value indicating the deviation of the air-fuel ratio and the response delay time involved in the step of controlling the air-fuel ratio feedback correction value; and correctively setting the air-fuel ratio feedback correction value with the correction value within the period.

* * * * *